US005139451A

United States Patent [19]

Dougherty et al.

[11] Patent Number: 5,139,451

[45] Date of Patent: Aug. 18, 1992

[54] PROCESSING AND PROTECTING A FOIL SHADOW MASK FOR A TENSION MASK COLOR CATHODE RAY TUBE

[75] Inventors: Lawrence W. Dougherty, Sleepy Hollow; Sam H. Kaplan, Chicago, both of Ill.

[73] Assignee: Zenith Electronics Corporation, Glenview, Ill.

[21] Appl. No.: 636,057

[22] Filed: Dec. 31, 1990

[51] Int. Cl.[5] ..... H01J 9/00; H01J 29/07

[52] U.S. Cl. ..... 445/30; 445/37; 430/5; 156/631; 156/644

[58] Field of Search ..... 445/30, 37, 47; 156/631, 644; 430/5

[56] References Cited

U.S. PATENT DOCUMENTS 3,944,867 3/1976 Kaplan ..... 313/403
4,705,357 11/1987 Dietch ..... 313/402
4,755,257 7/1988 Yamamoto et al. ..... 156/631
4,790,786 12/1988 Strauss ..... 445/68
4,828,523 5/1989 Fendley et al. ..... 445/30
4,902,257 2/1990 Adler et al. ..... 445/4
4,926,089 5/1990 Moore ..... 313/403
4,942,332 7/1990 Adler et al. ..... 313/402

*Primary Examiner*—Kenneth J. Ramsey

[57] ABSTRACT

A component-in-process comprises an ultra-thin foil shadow mask having on at least one side thereof a lamina having a composition and thickness effective to physically support and protect the mask during subsequent processing operations. Such operations include forming apertures in a foil mask blank mounted on a lamina, electroforming a foil mask on a lamina, and etching a mask mounted on a lamina to reduce overall thickness or selectively thin it.

28 Claims, 4 Drawing Sheets

PROCESSING AND PROTECTING A FOIL SHADOW MASK FOR A TENSION MASK COLOR CATHODE RAY TUBE

BACKGROUND OF THE INVENTION

1. Field of the Invention

This invention relates to tension mask color cathode ray picture tubes, and is addressed specifically to improved means and method for the manufacture of tension masks used in such tubes. The invention is applicable to the manufacture of color tubes of various types, including those used in home entertainment type television receivers of both standard resolution and high definition, and in medium-resolution and high-resolution tubes used in color monitors.

The tension foil shadow mask is a part of the cathode ray tube front assembly, and is located in close adjacency to the face panel. As used herein, the term "shadow mask" means an apertured metallic foil which may, by way of example, be about 0.001 inch thick, or less. As is well known in the art, the shadow mask acts as a color-selection electrode, or "parallax barrier," which ensures that each of the three beams generated by the electron gun located in the neck of the tube lands only on assigned phosphor targets. The mask is supported in high tension a predetermined distance from the inner surface of the face panel by one or more support structures known as "rails." The predetermined distance is termed the "Q-height."

The apertured in-process foil that comprises the mask is stretched over the rails and welded thereto. The stretching of a mask is described and claimed in U.S. Pat. No. 4,790,786 to Strauss, of common ownership herewith, and the welding of a mask to the rails is described and claimed in U. S. Pat. No. 4,828,523 to Wichman et al.

A major problem endemic to the manufacture of shadow masks is plugging of the apertures. The problem is particularly acute in the processing of tension mask—the apertures are very small, of the order of 0.0036 inch, and there may be as many as half a million of them in a high-resolution tube. The clogging of even one aperture can be cause for rejection of a tube, and since there are at least 24 distinct steps in the procesing of a shadow mask, occluded apertures are a common problem. Occluding materials include airborne or human borne dust particles, and pieces of lint, which can hook themselves into an aperture and defy most attempts to dislodge them, such as by vibration or air blasting. Even speaking in the vicinity of an in-process mask can result in drops of saliva spraying onto the apertures and occluding them to the detriment of further processing.

The fragility of a foil shadow mask leads to another problem—that of handling it without physical damage. This is especially true of an ultra-thin masks; that is, a mask having a thickness on the order of 0.0006 inch or less. Also, a mask having a pattern of slits is inherently fragile, such as the tied slit mask described and claimed in U.S. Pat. Nos. 4,942,332 and 4,926,089, of common ownership herewith.

2. Prior Art

In U.S. Pat. No. 4,705,357, of common ownership herewith, there is described means for the preventing the occlusion of apertures during the processing of conventional curved shadow masks and flat tension masks. A removable film is disposed on at least one side of the mask to prevent particle occlusion of apertures. The film has an extremely small, substantially uniform thickness dimension, a low index of refraction, and is of such high transparency as to exhibit a negligible optical effect during photoscreening operations. The thickness of the film is in the range of 4 to 6 microinches. The film is also pyrolizable so that it will burn off during an ensuing frit-sealing process. The film is applied to the apertured mask blank by a "flotation" process; that is, the mask blank is immersed in a tank of deionized water, and a filming solution, which may comprise a nitrocellulose compound, is applied to the surface of the water. The water is then drained from the tank. As a result, the film drapes itself over the mask. The final steps in the process include drying of the film and inspection of the mask to detect whether any apertures have been occluded. If so, the film is removed and the process is repeated.

Another example of a very thin film having a thickness in terms of microns is the "pellicle"—which is a form of container for enclosing an in-process semiconductor during the screening process. At the top of the container is an optically clear film spaced from the surface of the semiconductor. Dust particles falling on the film are outside the depth of field of the lens used in the screening process and hence do not affect the process.

A gelatin-based anti-static film may be applied to the back surface of a web of drafting film; its purpose is to prevent static build-up as the web is conveyed at high speeds. The film may be either sprayed or rolled on.

OBJECTS OF THE INVENTION

It is a general object of the invention to provide means and method for facilitating the manufacture of foil tension mask color cathode ray tubes.

It is another general object to facilitate the handling of very thin foil materials used in tension masks.

It is an object of the invention to provide for physically supporting and protecting in-process foil shadow masks during all stages of color cathode ray tube manufacture.

It is a further object of the invention to shield foil mask apertures from occlusions during shipping and processing operations.

It is yet another object of the invention to provide for the manufacture and physical support of foil slot masks such as the tied slit mask described and claimed in referent U.S. Pat. Nos. 4,942,332 and 4,926,089, of common ownership herewith.

It is an object of the invention to provide for supporting in-process tension foil masks during selective thinning of the masks.

Finally, it is an object of the invention to provide a practical means for electroforming foil tension masks.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (noted as being not to scale), in the several figures of which like reference numerals identify like elements, and in which:

DESCRIPTION OF THE PREFERRED EMBODIMENT

Figure 1:
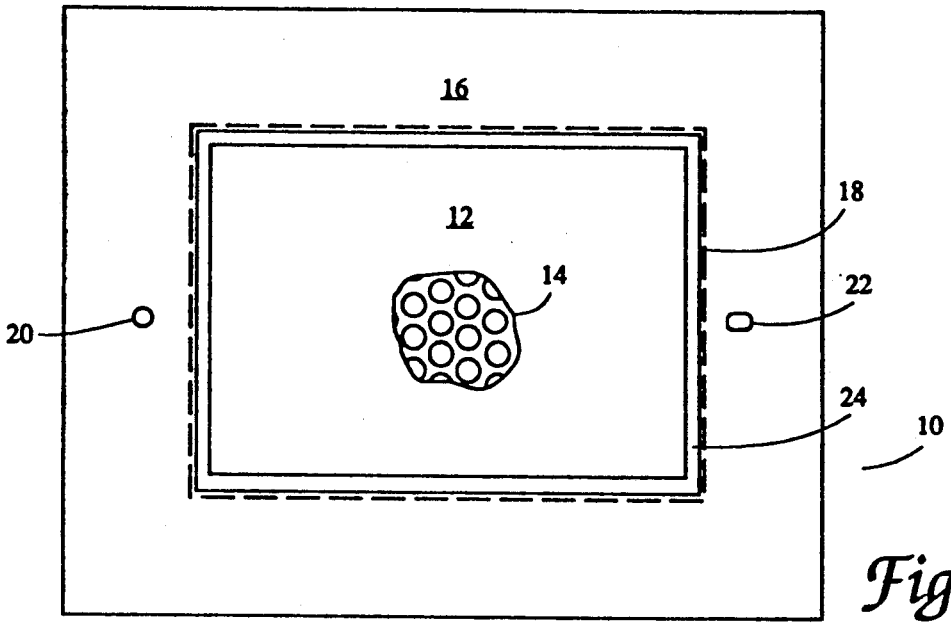
FIG. 1 is a plan view of an apertured foil shadow mask, the manufacture of which is facilitated by the means and method according to the invention; an inset depicts mask apertures greatly enlarged.

With reference to FIG. 1, there is depicted an in-process foil shadow mask 10. Mask 10 includes a center field 12 of apertures shown greatly enlarged in inset 14. The apertures provide for the color selection function in the finished tube. Center field 12 is enclosed by a border 16 of unapertured metal which is trimmed off in a later operation at trim line 18, indicated by the dashed line. A round perforation 20 is located in border 16 with an elongated perforation 22 opposite; these perforations provide for registering mask 10 with mating pins (not shown) on the factory fixture frame described and claimed in referent U.S. Pat. No. 4,790,786; reference to this patent is suggested for an understanding of the process of stretching a mask 10 in a factory fixture frame, printing a phosphor screen on a mating faceplate, and welding the mask to a mask support structure that extends from the faceplate. The mask support structure occupies the space 24 that lies between the center field 12 of apertures and trim line 18.

Figure 2:
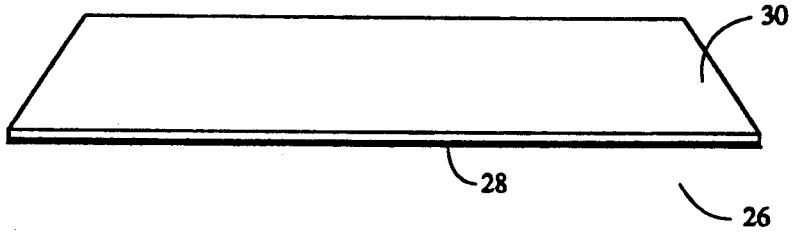
FIG. 2 is a cross-sectional view in elevation of foil shadow mask of FIG. 1 having a lamina on one surface.
Figure 3:
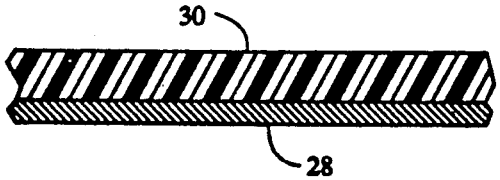
FIG. 3 is a greatly enlarged view of a section of FIG. 2.

With reference to FIGS. 2 and 3, a component-in-process 26 according to the invention, as used in the manufacture of a tension mask color cathode ray tube, comprises a foil shadow mask 28 having applied on at least one surface therefore a lamina 30. FIG. 3 indicates symbolically the composition of the mask 28, indicated as being iron (or steel), and the lamina 30, indicated as comprising a plastic material. Lamina 30 has a composition and thickness effective to physically and protect mask 28 during subsequent processing operations. The lamina also provides for protection against aperture occlusion. By way of example, the mask 28 may have a thickness of 0.001 inch or less, and the lamina may have a thickness in the range of 0.0005 inch to 0.10 inch.

The physical support and protection provided by the lamina according to the invention is necessary because of the thinness and inherent fragility of certain foils used as masks. By way of example, a mask made by electroforming may have a thickness of as little as 0.0002 inch; as a result, it is non-self-supporting and is subject to tearing, wrinkling and other deformation. Also, a foil mask rolled to a thickness of 0.001 inch may be selectively thinned (as will be described) to a thickness of 0.0002 inch, with consequent fragility.

Further with regard to thickness of the lamina, when used in conjunction with a mask having a thickness of 0.001 inch or less, the lamina may, as noted have a thickness in the range of 0.001 inch to 0.10 inch. The thickness required depends on the diagonal measure of the tube in which the mask is to be used, whether 14-inch, or larger sizes such as 19-inch and 27-inch tubes. An inherently sturdy mask, such as a foil mask of 0.001 inch thickness, would only require a lamina having an equivalent thickness. A very thin, inherently fragile foil mask—one only 0.0002 inch thick, for example—would require a more supportive lamina, one having a thickness of about seven mils. The thickness of a lamina for supporting and protecting a such a mask for a 27-inch tube could be as much as 0.10 inch.

Figure 4:
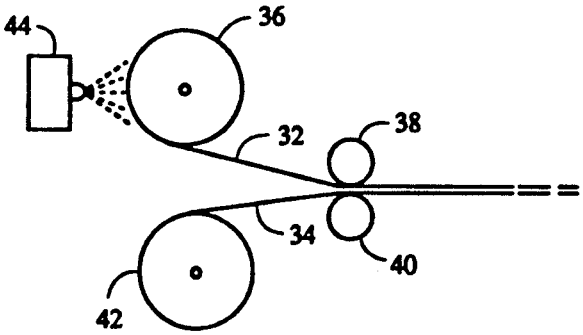
FIG. 4 depicts schematically the application of a physically supportive and protective lamina to a metal foil according to the invention.

FIG. 4 depicts the application of a supportive and protective lamina 32 to a foil shadow mask blank 34. The lamina 32 is drawn from a web or roll 36. Lamina 32 is fed to rollers 38 and 40 where it is pressed against a metal foil comprising the shadow mask blank 34, also drawn from a web or roll 42.

The lamina 32 may comprise a plastic material which is temporarily adhered to the mask blank. It may be temporarily adhered to the metal of the mask by a releasable cement, the application of which is indicated by spray means 44, shown as beind directed toward the lamina 32 on web 36; the spray may as well be directed toward the web 42 of metal foil 34. The characteristics of the releasable cement must be such that it can be readily removed when its purpose is fulfilled, and there must be no residue left after its removal to poison the internal environment of the cathode ray tube envelope. The releasable cement may comprise, by way of example, a natural or synthetic latex, or a pressure-sensitive adhesive or a hot-melt adhesive.

The adherence of the lamina to the mask should be such that the lamina will adhere adequately during all subsequent production processes, yet not so firmly that it cannot be removed readily. The adherence should be such that the lamina can be peeled off easily by hand or by a simple machine process. Any residue remaining must be of such nature that it will decompose completely when the temperature of the tube envelope is raised to the frit sealing temperature required when the faceplate is fused to the tube envelope. Another important characteristic of the lamina is flexibility, in that it can remain attached to the mask while the mask is being stretched over the mask-support rails, and do so without affecting the mask-stretching operation, as will be shown and described.

The lamina may also constitute a material which pyrolizes or sublimes under a high temperature, such as the temperature incidental to the fritting of the faceplate to the funnel. Again, it is important that the lamina be completely expunged and leave no contaminative residue on the surface of the foil. A material of this type can be formed from nitrocellulose. Also, it may comprise a material that can be dissolved quickly by a suitable solvent.

Since etching is an important part of the inventive process, it is important that the laminar material be immune to the corrosive effects of the etchant used, which may comprise a strong solution of ferric chloride, by way of example. Any adhesive used to adhere the lamina to the metal of the mask must be similarly immune to the effects of the etchant.

Installation of the tensed, laminated mask on the mask support structures extending from the faceplate makes necessary the step of securing the metal of the foil to the metal of the support structure. Welding by a high-energy beam such as a laser is the preferred method of securement, and it is necessary that the material of the lamina be readily penetrated by the laser beam. Also it must be immune to the intense heat of the beam in that it must not melt and form indissoluble globules on the surface of the weld, nor must it exude dangerous fumes.

Materials suitable for lamina may comprise polyvinyl chloride, polyethylene or Mylar.

It is also desirable in some applications that the lamina be transparent to visible light. This characteristic is important in the manufacture of color cathode ray tubes by the interchangeable mask system, in which selected apertures in the mask are aligned with an underlying phosphor dot pattern by optical means, such as that described and claimed in referent U.S. Pat. No. 4,902,257, of common ownership herewith. Also, a transparent lamina facilitates the inspection of the mask to which it is adhered, especially with regard to the possibility of aperture occlusion. A laminar material of suitable transparency may be formed from nitrocellulose.

The lamina may also serve as a base for supporting a mask as it is selectively thinned or thickened according to the invention.

The lamina not only provides physical support and protection, but also serves according to the invention as a matrix or base upon which a foil mask is electroformed. When serving this purpose, it must be receptive to electroforming, and to the release of the electroformed article when the process is completed.

As materials for lamina are not inherently electrically conductive, a surface of the lamina must be made so by the application of an electrically conductive film. Polyvinyl chloride, polyethylene or Mylar can be so coated to provide electrical conductivity. Mylar films having a very thin coating of metal evaporated on one surface are available commercially and are suitable as lamina for electroforming by electrolysis.

Generally, the process of depositing a conductive metal on an electrically non-conductive plastic material is by vapor deposition, hot stamping, or electroplating. Here follows a description of an electroless method of depositing a conductive film on a material such as polyprolylene.

Carefully clean the surface of the material that is to be made electrically conductive. To sensitize the surface, dip the material in a dilute solution of palladium chloride. The dip material is an electroless nickel plating solution. After 30 to 120 minutes, a layer forms on the sensitized surface that can be electroformed with a layer of nickel. In the initial deposition of nickel, current density must be low; after 30 minutes, the current density can be increased. Another layer of nickel is then formed on the electroless nickel deposit, after which a shadow mask of iron can be electroformed on the layer of nickel. The dissimilarity of nickel and iron facilitates removal of the electroformed mask from the nickel coating on the lamina.

Figure 5:
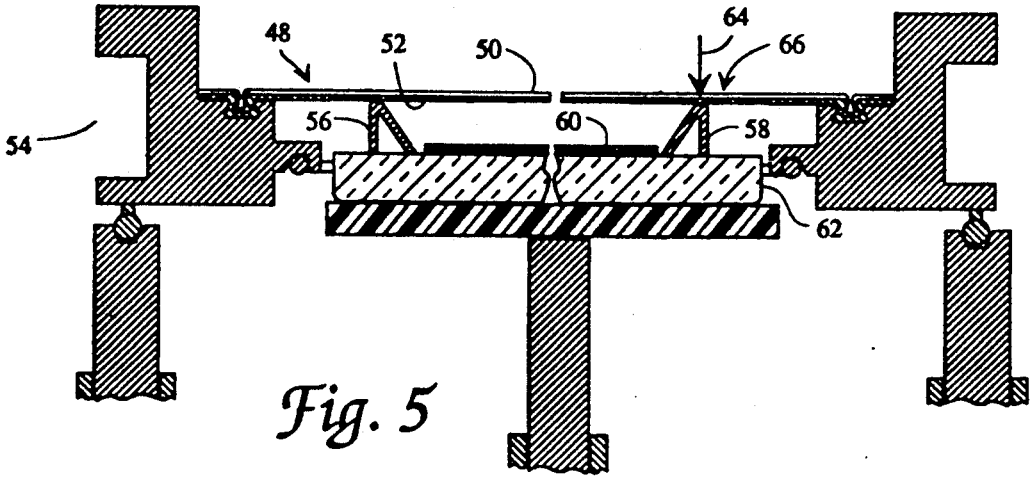
FIG. 5 is a view in elevation showing diagrammatically the the process of welding a foil mask laminated according to the invention to a mask support structure.

FIG. 5 depicts a step in the manufacture of a tension mask color cathode ray tube in which a foil shadow mask is installed on the faceplate of the tube. The figure is based on FIG. 11B of U.S. Pat. No. 4,790,786, to which reference is suggested. The '786 patent describes the use of a factory fixture frame that provides for the precise registration and re-registration of an in-process shadow mask with a lighthouse and an in-process faceplate during the photoexposure of the faceplate.

A laminated foil shadow mask 48, comprising a lamina 50 applied to one side of a foil mask 52, is indicated as being stretched in a factory fixture frame 54, as described in the '786 patent. The foil side of the laminated mask 48; that is, the side opposite the side having the lamina thereon, is shown as being stretched over rails 56 and 58, which are located on opposed sides of a phosphor screen 60 centrally disposed on a faceplate 62. The mask 52 is then welded to rails 56 and 58 by a high-energy beam 64, the path of which is shown by an arrow. Beam 64, which may comprise the beam of a carbon dioxide laser, is used the weld mask 52 to the rails through the lamina 50 according to the invention. Upon completion of the welding, the beam moves outwardly to sever mask 52 from the factory fixture frame 54 at trim line 66. The lamina 50 over the apertured area; that is, within the area encompassed by the welding, is then removed. The lamina in the area of the mask 52 that lies outside the rails 56 and 58 does not have to be removed as the foil and associated lamina remain clamped in the factory fixture frame 54, and are later removed from the frame and discarded.

The presence of the plastic lamina does not cause interference with the mask-stretching process, as the strength of the mechanical mask-retaining means used in conjuction with the factory fixture frame described in the '786 patent is adequate to penetrate the thin lamina and firmly grasp the metal of the foil blank.

Apertures may be formed in a foil shadow mask blank by applying a flexible lamina on the blank and forming a pattern of apertures in the blank. With reference of FIG. 6, there is depicted an in-process shadow mask blank 70 on which has been applied a flexible, etch-resist lamina 72, indicated as being on the side opposite the viewer. Rectangle 74 indicates the limits of a center field where apertures are to be formed in the blank. Inset 76 is a depiction, greatly enlarged, of the apertures 78, shown as being round.

A shadow mask matrix pattern of photoresist 80 resistant to an etchant is formed on the foil mask blank 70 having a pattern of openings corresponding to the desired pattern of apertures in the blank, shown as being round apertures 78. The etch resist 80 may comprise a either a positive or negative type. The blank is put into a light house and the resist is exposed to light actinic to the resist to form a shadow mask matrix pattern surrounding a desired aperture pattern. To hold it perfectly flat during the lighthousing step, the blank is placed on a vacuum frame. The mask blank is then washed with a solution that removes the resist over the apertures 78. The blank is then etched with an etchant for a time effective to remove the metal of the aperture pattern to produce an apertured mask.

If a negative resist is used, it may comprise a Norland type of negative resist. The solution for removing the resist over the areas where apertures are desired may comprise a caustic base solution. The etchant may comprise ferric chloride having a concentration of 42 Baume sprayed from a battery of spray heads, all as is well known in the art.

Figure 6:
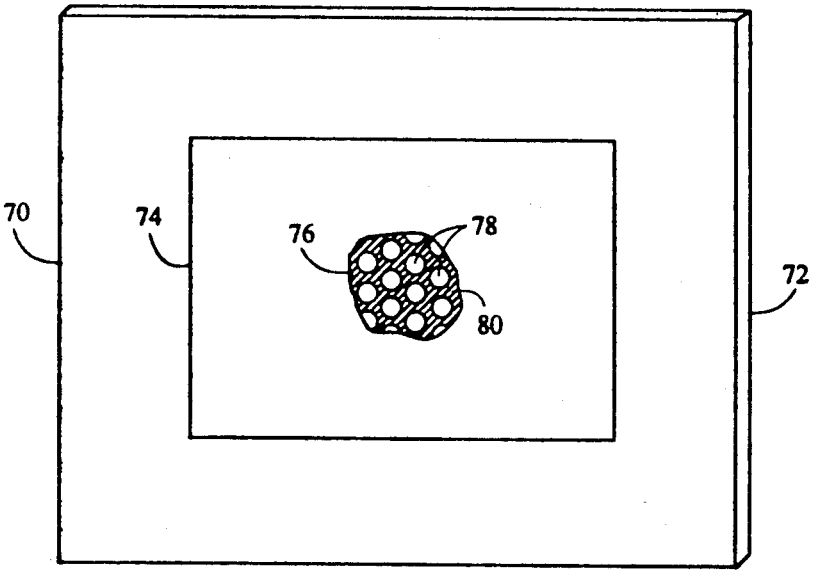
FIGS. 6–9 are plan views of various embodiments of foil masks; insets show mask patterns greatly enlarged.
Figure 7:
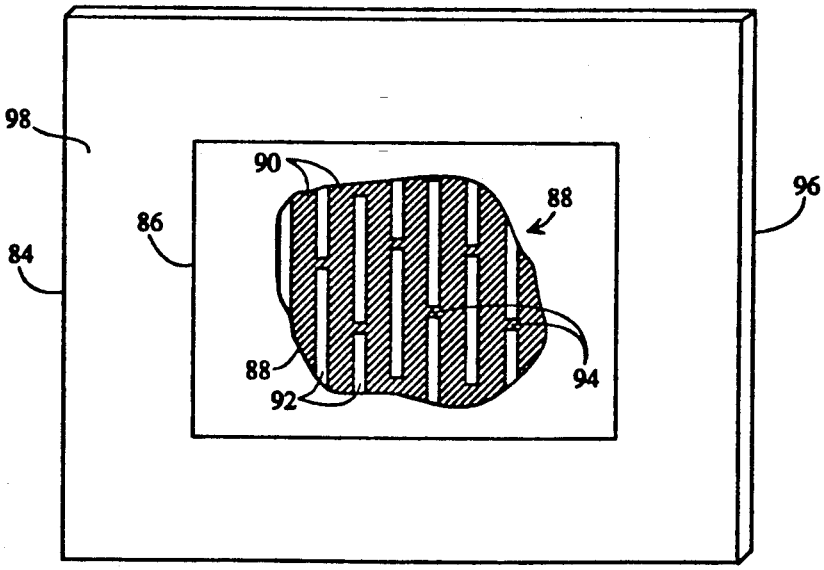

A tied slit foil mask, depicted in FIG. 7, may be formed in a foil shadow mask blank by the method described in connection with FIG. 6. In FIG. 7, there is depicted an in-process shadow mask blank 84 on which the pattern of a tied slit mask is to be formed within the limits of a center field indicated by rectangle 86. Within inset 88 is a depiction, greatly enlarged, of the pattern 88 of a tied slit mask. A tied slit mask comprises a series of parallel strips 90 separated by slits 92, with the strips 90 loosely coupled by widely spaced ties 94, all as is fully described and claimed in U.S. Pat. No. 4,942,332, of common ownership herewith.

An etch-resistant lamia 96, noted as being flexible, is applied on the back side of mask blank 84, as indicated. A shadow mask matrix pattern of photoresist is deposited on the foil mask blank 84 having a pattern of openings corresponding to the pattern of a tied slit mask. As with the blank described in connection with FIG. 6, the blank is held flat in a vacuum frame. A layer of photoresist 98 is applied to the foil side of the blank 84; that is, the side opposite the side on which the lamina 96 is applied. The photoresist is exposed in a lighthouse to light actinic to the photoresist to render insoluble the photoresist over the pattern of strips 90 and tie bars 94. The soluble photoresist that lies over the slits is then washed off, and the blank is etched with an etchant for a time effective to remove the metal of the blank that comprises the slits, thus forming the aperture pattern in the blank of a tied slit mask.

It is noted that the process can be used to form any desired type of aperture pattern in a foil mask other than the two patterns showns and described.

Figure 8:
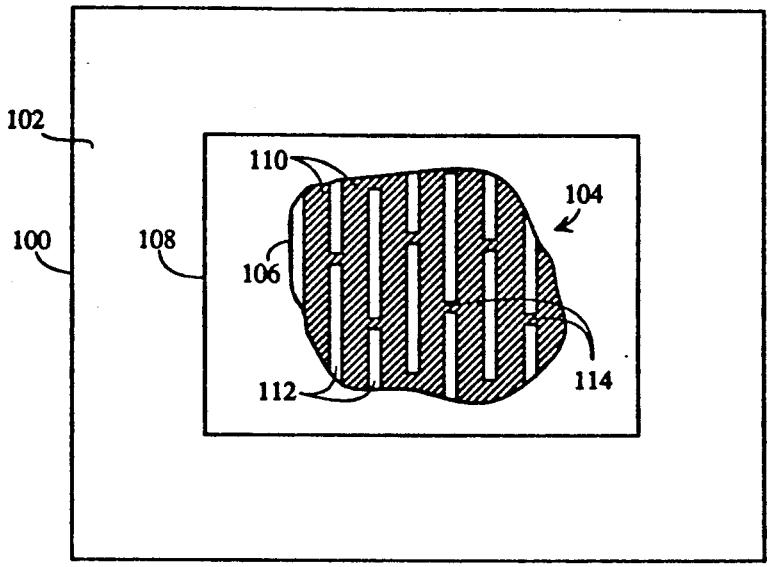

An apertured foil shadow mask may be electroformed on a lamina according to the invention. With reference to FIG. 8, there is indicated a plastic lamina 100 having a patterned electrically conductive surface 102 on a side thereof. The pattern is the pattern of a tied slit mask 104, indicated greatly enlarged in the inset 106. Rectangle 108 indicates the limits of the center field of tied slit mask apertures. As noted heretofore, the pattern of a tied slit mask comprises a series of parallel strips 110 separated by slits 112, with the strips 110 being loosely coupled by widely spaced ties 114.

The electrically conductive surface 102 may comprise an electrically conductive film of metal such as aluminum or silver applied by vapor deposition, hot stamping or a plating process. The thickness of the film need only be about mil for adequate electrical conductivity.

Figure 9:
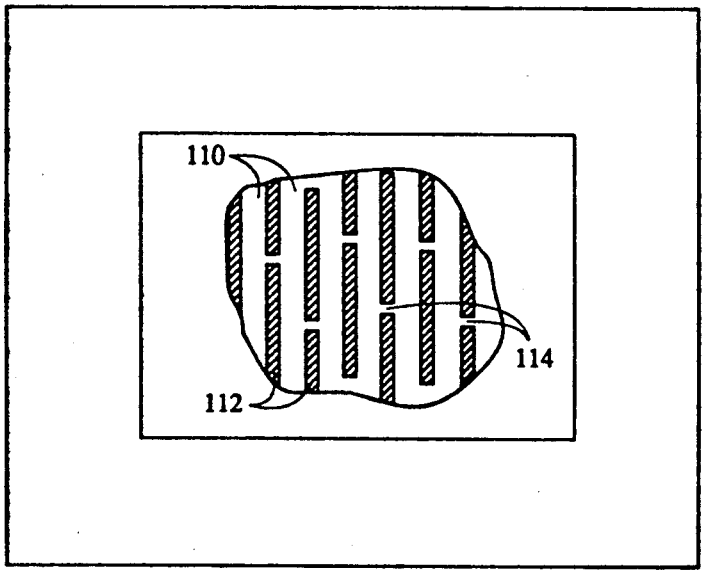

The patterned electrically conductive surface 102 comprises a pattern in which the parallel strips 110 and the loosely connected ties 114 are covered with an electroform photoresist such as Kodak Orthoresist (KOR) supplied by Eastman Kodak Company, Rochester, N.Y. The electroform photoresist is similar to the photoresist already described in that the pattern of the tied slit mask is project by means of a lighthouse on a layer of the photoresist coated on the electrically conductive surface 102. The result is that, after the unhardened photoresist is washed off, the strips 110 comprise the exposed metal of the electrically conductive surface 102. The resulting pattern is shown by FIG. 9, in which the areas that are to become slits 112 are indicated as being covered with a photoresist, leaving as bare metal the strips 110 and the ties 114.

Figure 10:
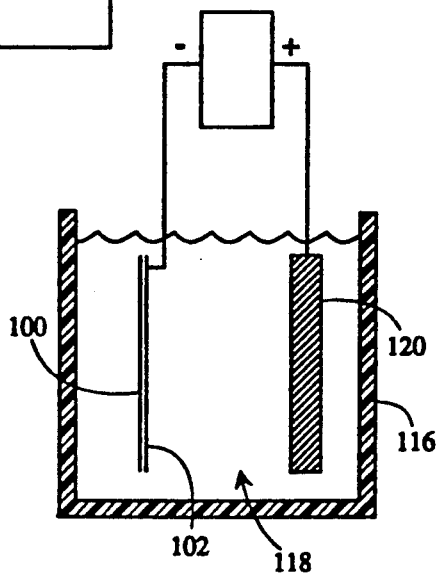
FIG. 10 is a view in elevation and in section of an electrolytic bath for electroforming a foil mask according to the invention.

As shown diagrammatically by FIG. 10, the lamina 100 is then immersed into an electrically conductive 116 bath containing an electrolyte 118 and a metallic anode 120. Anode 120 consists of a metal of a suitable composition; i.e., if the foil mask is to be iron, the anode 120 is also iron. The negative electrode of a direct current power source is connected to electrically conductive surface 102 of lamina 100, and a positive electrical potential is connected to anode 120. As a result, a tied slit metal foil shadow mask is electroformed on the patterned electrically conductive surface 102 of lamina 100.

A foil shadow mask having a round aperture pattern, as described in connection with FIG. 6 can be electroformed in exactly the same way, as can any other pattern of apertures.

The benefit, which is especially significant with regard to the tied slit mask, is that the mask can be made very thin; e.g., of the order of 0.0002 inch to 0.0004 inch. Also, this relatively fragile and unstable electroformed foil with its pattern of slits and ties is supported and protected after it is electroformed by the lamina according to the invention all through the steps of manufacturing the front end of the cathode ray tube, including the stretching of the mask and welding it to the rails, as described in connection with FIG. 5.

Because of the high tension to which the foil of the mask is subjected as it is stretched over the mask supports, the tensile strength of the electroformed foil must necessarily be in the range of 70 to 90 kpsi. As a result, a composition of iron is preferred as the electroplating material. A suitable electrolytic bath for electroplating iron is provided on page 176 of the book *Electroforming* by Peter Spiro, published by Robert Draper, Ltd., in 1971.

When electroforming iron masks according to the invention, factors and techniques well-known to those skilled in the electroforming art must be carefully followed, such as proper bath temperature, electrical potential, circulation of liquid in the bath, throw distance, and planoparallelism of the lamina (the cathode) and the surface of the anode.

The overall thickness of an in-process mask may be reduced, or "thinned" according to the invention by the following process. A temporary lamina is applied to the in-process mask. The mask may be the form of an apertured foil as shown by FIGS. 6–9, or an unapertured mask blank having a thickness by way of example of 0.001 inch. The foil side of the foil is exposed to an etching compound for a predetermined time to thin the mask to a predetermined thickness. The mask is then washed to remove the etchant, and the lamina is removed, preferably after the mask is welded to the underlying shadow mask support, as described in connection with FIG. 5. As before, the etchant may comprise ferric chloride having a concentration of 42 Baume sprayed from a battery of spray heads, as is well known to those skilled in the art.

The tied slit mask shown of FIG. 7 may be selectively thinned according to the invention to make the ties thicker than the strips and hence increase resistance of the mask to tension on the x-axis. The selective thinning of the tied slit mask preferably takes place after the electroforming of the mask as described in conjunction with FIG. 7. After the tied slit mask has been formed to a thickness of 0.001 inch, for example, the side of the mask opposite the lamina 96 (please refer to FIG. 7) is coated with a suitable photoresist. The resist that lies over the ties 94 is exposed to light actinic to the resist. The mask is then washed with a solution effective to remove the unexposed photoresist over the strips 90. The exposed metal of the mask is etched with an etchant for a time effective to thin strips 90 to a predetermined thickness. For example, if the metal of the ties 94 is 0.001 inch thick, the strips may be thinned by the inventive process to a thickness of only 0.0002 inch.

Similarly, the overall thickness of a mask blank can be reduced while forming apertures in the blank. A flexible lamina having an electrically conductive side is temporarily applied to a shadow mask blank. The foil side of the blank is etched for a predetermined time to thin the mask to a predetermined thickness of, for example, 0.0002 inch. A layer of photoresist is applied to the foil, and the photoresist is exposed to light actinic to the photoresist to form a matrix pattern surrounding an aperture pattern. The mask is washed with a solution effective to selectively remove the photoresist and expose the metal of the aperture pattern. The mask is then etched with an etchant for a time effective to remove the metal of the aperture pattern and form an apertured mask of desired thickness.

The advantage of first thinning the blank before forming the apertures in the blank lies in the fact that the size of the apertures can be precisely controlled. If, for example, the apertures were first formed in the mask blank before the blank was thinned by and etchant, the metal that defines the apertures would be seriously enlarged due to undercutting by the etchant. The result is that by the time the apertured blank was etched to a thinness of 0.0002 inch, the diameter of apertures of the end-product would be twice as great as desired, and the apertures would be far from circular.

There are many possible variations of the processes described in the foregoing, all within the scope of the invention, and readily appreciated by those skilled in the art. For example, rather than selectively thinning selected parts of a mask by use of an etchant, such as the ties of the tied slit mask shown by FIG. 7, a tied slit mask can be electroformed to a thickness of 0.0002 inch on the lamina, as has been described in connection with FIGS. 7-9. The pattern of the mask could then be overcoated with a photoresist, the resist removed over the area of the ties, and the electroforming process continued to plate the ties to the desired thickness.

Figure 11:
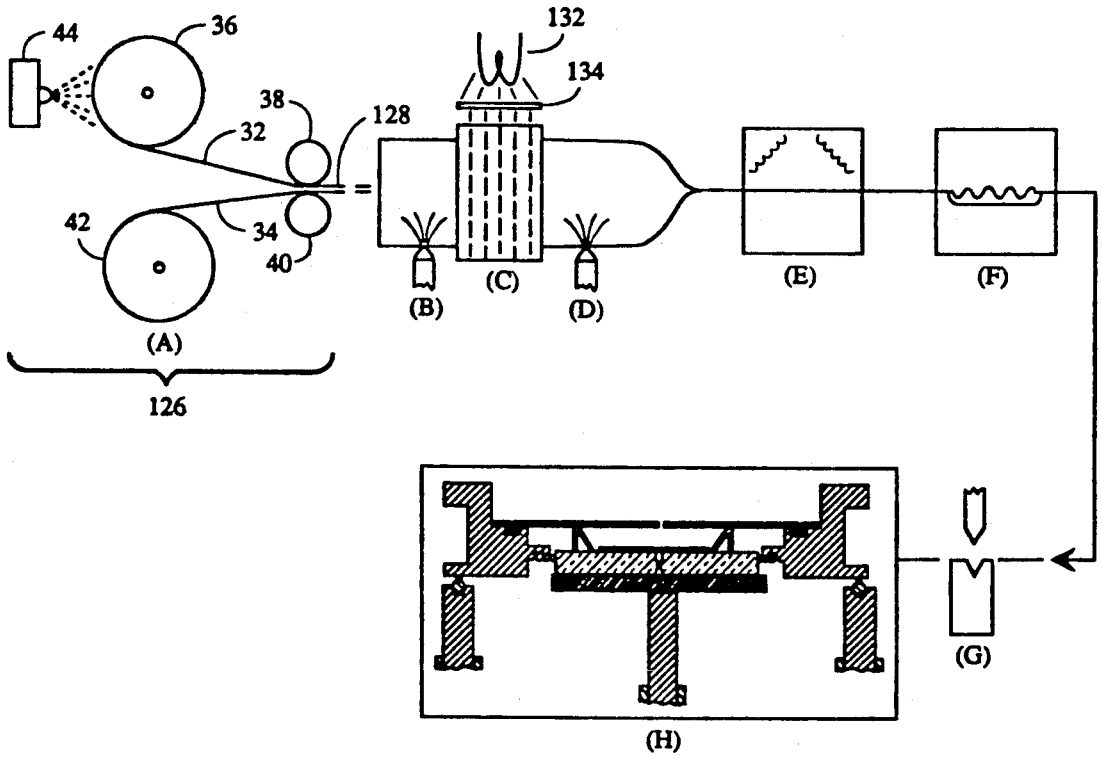
FIG. 11 is a schematic flow diagram depicting a method of making foil shadow masks laminated according to the invention.

The flow diagram of FIG. 11 depicts the steps in making a foil shadow mask laminated according to the invention. The bracketed portion 126 will be recognized as a copy of FIG. 4 which depicts the application of a supportive and protective lamina 32 to a foil shadow mask blank 34 (step A). Following lamination, the foil side of laminate 128 is coated with a photoresist material (Step B). The photoresist layer is exposed to light 132 which is actinic to the resist through a registered aperture pattern master 134 (Step C) which forms the desired mask pattern in the resist, whether a dot pattern or a tied slip pattern. The photoresist is then "developed" by means of a caustic spray which removes the unexposed resist (Step D). The photoresist is exposed to heating elements to harden it and make it resistive to the etchant (Step E). The apertures are etched through the foil and the photoresist is stripped (removed) from the foil (Step F). The web is cut to form a separate mask such as that shown by FIG. 1 (Step G). The laminated mask is then installed on the rails (Step H; see FIG. 5 and associated description).

The sequential process depicted by FIG. 11 may as well, by the substitution of steps, be used to electroform a mask on a protective and supportive lamina, as described in connection with FIG. 6. Also, the sequential process of FIG. 11 may be used to etch a mask mounted on a lamina to reduce its overall thickness or selectively thin it, as described in connection with FIGS. 7-9.

The material of the lamina may be pyrolizable; that is, it will burn off during subsequent tube processing operations when tube temperature is raised to frit-devitrifying temperatures. A lamina material of this type may comprise a nitrocellulose. Also, the material of the lamina may be one that is soluble; for example, one can be quickly dissolved by a solvent.

The benefits of the inventive process include:

1. The lamina, by its overall adherence to the mask, "stabilizes" the structure of the mask during the stretching process.
2. The lamina shields the apertures from cntamination.
3. the lamina physically supports thin, non-self-supporting foil masks to facilitate handling during shipment and processing.
4. The lamina can remain on the in-process mask and fulfill its protective and supporting function while the mask is stretched over the rails, and welded to the rails.
5. Very thin, fragile, non-self-supporting foil masks such as the tied slit mask, can be formed on a lamina which protects and supports the foil through all the processing steps.
6. The mask of 5, above, can be selectively thinned while mounted on a lamina.
7. Masks can be made thinner; e.g., less than 0.0005 inch, with these corresponding benefits—
   a. Less tension required to stretch the mask, with consequent less tension on the rails and the faceplate on which the rails are mounted.
   b. The electron optical properties of the very thin mask are superior to those of the thicker mask.
   c. The thermal properties of the very thin mask are superior; that is the power handling capability is greater because it dissipates heat resulting from electron bombardment at a greater rate.
   d. There is a weight reduction because of the reduction of material in the mask.
   e. There is a cost reduction because of less material.
   f. There is a cost reduction over forming very thin foil masks by the rolling process in that the cost goes up almost exponentially when rolling masks to a thickness less than 0.001 inch.
   g. Masks can initially be made thick by a rolling process, then thinned to the desired thickness.
   h. Selected areas of a foil mask can be made thicker or thinner.

While a particular embodiment of the invention has been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

We claim:

1. For use in the manufacture of a tension mask color cathode ray tube, a component-in-process comprising an ultra-thin foil shadow mask having applied on at least one side thereof a lamina having a composition and thickness effective to physically support and protect said mask during subsequent processing operations including etching apertures in said mask, stretching said mask over mask support members, and welding said mask to said mask support members.

2. The component-in-process according to claim 1 wherein said mask has a thickness of less than 0.0006 inch and said lamina has a thickness in the range of 0.0005 inch to 0.10 inch.

3. The component-in-process according to claim 1 wherein said mask is apertured and said lamina provides protection against aperture occlusion.

4. The component-in-process according to claim 1 wherein said lamina is transparent to visible light.

5. The component-in-process according to claim 1 wherein said lamina comprises a plastic material.

6. The component-in-process according to claim 1 wherein said lamina is temporarily adhered to said mask.

7. The component-in-process according to claim 6 wherein said lamina is temporarily adhered to said mask by a releasable cement.

8. The component-in-process according to claim 6 wherein said lamina comprises a self-adhering material.

9. The component-in-process according to claim 1 wherein a surface of said lamina is electrically conductive.

10. For use in the manufacture of a color cathode ray tube, a component-in-process comprising a very thin, inherently fragile slit-type mask having a series of parallel strips separated by slits, the strips being loosely coupled by widely spaced ties, said mask having on at least one side thereof a lamina having a composition and thickness effective to physically support and protect said mask during subsequent processing operations.

11. For use in the manufacture of a tension mask color cathode ray tube, a component-in-process comprising an ultra-thin apertured foil shadow mask having a thickness of less than 0.0006 inch, said mask having temporarily applied on at least one side thereof a plastic lamina having a thickness in the range of 0.0005 inch to 0.10 inch, and having a composition and thickness effective to physically support and protect the apertures of said mask from aperture occlusion during subsequent processing operations.

12. For use in the manufacture of a tension mask color cathode ray tube having an apertured foil shadow mask, a method for protecting an ultra-thin in-process mask during manufacture comprising:

providing a lamina having x-y dimensions no less than those of said mask;

formulating said lamina to have a composition and thickness effective to physically support said mask and shield said apertures from occlusion; and applying said lamina to said mask.

13. The process according to claim 12 including temporarily applying said lamina to said mask.

14. The process according to claim 13 including applying a temporary adhesive either to said mask or said lamina.

15. The component-in-process according to claim 12 including forming said mask to a thickness of less than 0.0006 inch and forming said lamina to a thickness in the range of 0.0005 inch to 0.10 inch.

16. The component-in-process according to claim 12 including forming said lamina from a flexible material.

17. The component-in-process according to claim 12 including forming said lamina from a plastic.

18. The component-in-process according to claim 12 including formulating said lamina from a transparent material.

19. For use in the manufacture of a tension mask color cathode ray tube having a metal foil shadow mask, a method for forming a pattern of apertures in an ultra-thin in-process foil shadow mask blank, comprising:

applying on said blank a flexible lamina;

forming a pattern of etch resist on said blank having a pattern of openings corresponding to the desired pattern of apertures in said foil; and etching said blank from one side through said openings to form said pattern of apertures in said blank.

20. For use in the manufacture of a tension mask color cathode ray tube having an ultra-thin metal foil shadow mask, a method for forming a pattern of apertures in an in-process foil shadow mask blank and protecting the resulting shadow mask during CRT manufacture, comprising:

applying on a first side of said blank a flexible, etch-resistant lamina;

applying a layer of photoresist to a second side of said blank;

exposing said photoresist to light actinic to said photoresist to form a shadow mask matrix pattern surrounding an aperture pattern;

washing said mask with a solution effective to selectively remove exposed photoresist to expose the metal of the aperture pattern;

etching said blank with an etchant for a time effective to remove said metal of said aperture pattern and form as apertured mask;

transporting the apertured mask with its supporting lamina to at least one additional processing area;

stretching and welding said lamina to mask-support members; and removing the lamina upon welding the mask to mask support members.

21. For use in the manufacture of a tension mask color cathode ray tube having a tied slit mask comprising a series of parallel strips separated by slits, the strips being loosely coupled by widely spaced ties, a method for forming a very thin, inherently fragile mask from an in-process foil shadow mask blank and protecting the resulting shadow mask, comprising:

applying on a first side of said blank a flexible, etch-resistant lamina;

applying a layer of photoresist to a second side of said blank;

exposing said photoresist to light actinic to said photoresist to form the pattern of a tied slit mask;

washing said mask with a solution effective to selectively remove exposed photoresist to expose the metal of the aperture pattern;

etching said blank with an etchant for a time effective to remove said metal of said aperture pattern and form an apertured mask;

transporting the apertured mask with its supporting lamina to at least one additional processing area;

stretching and welding said lamina to mask-support members; and removing the lamina upon welding the mask to mask support members.

22. For use in the manufacture of a tension mask color cathode ray tube having a tied slit mask comprising a series of parallel strips separated by slits, the strips being loosely coupled by widely spaced ties, a method for forming a very thin, inherently fragile mask from an in-process foil shadow mask blank and protecting the resulting shadow mask, comprising:

applying a flexible, etch-resistant lamina on said blank;

applying a layer of photoresist to the side of said blank opposite to said lamina;

exposing said photoresist to light actinic to said photoresist to render insoluble the pattern of said strips and tie bars;

washing off the soluble photoresist over the pattern of said slits;

etching said mask with an etchant for a time effective to remove said metal comprising said slits;

transporting the apertured mask with the supporting lamina to at least one additional processing area;

stretching and welding lamina to mask-support members; and removing the lamina upon welding the mask to mask-support members.

23. For use in the manufacture of a tension mask color cathode ray tube having a metal foil shadow mask, a method for forming an apertured foil shadow mask, comprising:

forming the pattern of an apertured mask on a flexible lamina;

electroforming on said lamina an apertured foil shadow mask.

24. For use in the manufacture of a tension mask color cathode ray tube having an apertured foil shadow mask, a method for forming an apertured mask by electroforming comprising:

providing a plastic lamina having a patterned electrically conductive surface on a side thereof;

immersing said lamina into a electrically conductive bath having a metallic anode immersed therein;

connecting said electrically conductive surface of said lamina to an electrically negative current source; and applying a positive electrical potential to said anode effective to electroform a metal foil on said patterned electrically conductive surface of said lamina.

25. The method according to claim 24 including depositing on said lamina an electroform photoresist having the aperture pattern of a shadow mask effective to form said foil into an apertured shadow mask.

26. For use in the manufacture of a tension mask color cathode ray tube having a metal foil shadow mask, a method for reducing the overall thickness of an in-process mask comprising:

temporarily applying a flexible lamina to said mask;

etching said mask for a predetermined time to thin said mask to a predetermined thickness;

washing said mask to remove said etchant; and removing said lamina.

27. For use in the manufacture of a slit-type metal foil shadow mask comprising a series of parallel strips separated by slits, the strips being loosely coupled by widely spaced ties, a method for selectively thinning the strips, comprising:

applying an etch-resistant lamina to one side of said mask;

coating the opposite side of said mask with a photoresist;

exposing said photoresist over said ties to light actinic to said photoresist;

washing said mask with a solution effective to remove the unexposed photoresist over said strips;

etching said mask with an etchant for a time effective to thin said strips to a predetermined thickness.

28. For use in the manufacture of a tension mask color cathode ray tube having a metal foil shadow mask, a method for reducing the overall thickness of a mask blank to form an ultra-thin mask with apertures therein, comprising:

temporarily applying on said blank a flexible lamina having an electrically conductive side;

etching for a predetermined time the foil side of said mask to thin said mask to a predetermined thickness;

washing said mask to remove said etchant;

applying a layer of photoresist on said foil;

exposing said photoresist to light actinic to said photoresist to form a matrix pattern surrounding an aperture pattern;

washing said mask with a solution effective to selectively remove exposed photoresist and expose the metal of the aperture pattern;

etching said mask with an etchant for a time effective to remove said metal of said aperture pattern.

* * * * *